US005603505A

United States Patent [19]

Acock

[11] Patent Number: 5,603,505

[45] Date of Patent: Feb. 18, 1997

[54] PORTABLE REMOTELY CONTROLLED POP-UP TARGET APPARATUS

[76] Inventor: Joseph B. Acock, 250 S. Sprague Rd., Coldwater, Mich. 49036

[21] Appl. No.: 342,383

[22] Filed: Nov. 18, 1994

[51] Int. Cl.[6] ..... F41J 7/06

[52] U.S. Cl. ..... 273/391; 373/403

[58] Field of Search ..... 273/348, 406, 273/391, 407, 410, 390, 392, 403, 404

[56] References Cited

U.S. PATENT DOCUMENTS

| | | | |
|---|---|---|---|
| 3,934,788 | 5/1962 | Cauble | 273/406 |
| 4,306,630 | 12/1981 | Monte et al. | 373/406 |
| 4,501,427 | 2/1985 | Payne | 273/406 |
| 4,540,182 | 9/1985 | Clement | 273/406 |
| 5,350,180 | 9/1994 | Acock | 273/406 |
| 5,403,017 | 4/1995 | Doss, III et al. | 273/391 |

FOREIGN PATENT DOCUMENTS

| | | | |
|---|---|---|---|
| 3532683 | 3/1987 | Germany | 273/391 |

*Primary Examiner*—Mark S. Graham
*Attorney, Agent, or Firm*—McCaleb, Lucas & Brugman

[57] ABSTRACT

A self-contained, power operated, portable target apparatus utilizing a base supported, linearally reciprocal carriage actuator driven by a reversible AC electric motor to actuate a crank along a vertical arc; the crank having pivotable connection with the carriage actuator at one end and positive fixed connection at its other end with a horizontal rotatably supported drive shaft for partially rotating the shaft in response to limited linear movements of the carriage actuator. Two, laterally spaced co-planar lift arms are secured to the shaft for movement between vertical and horizontal positions. Elongated target supporting pins project from near the outer free ends of the lift arms for inserted reception in connector sockets extending into the body of a three dimensional target. Heavy springs are coupled to the carriage actuator for assisting the motor in overcoming the inertia of the target load as it is raised from a horizontal or prone hidden position to an upright display position. Remote motor controls serve to actuate the motor which is powered from a portable battery/AC convertor power source. Modified telescopic shafts, shaft supports and adjustable target supports adapt the target apparatus to targets of various sizes and dimensions.

5 Claims, 6 Drawing Sheets

136
126
148
150
145
31
125
124
127
90
23
95
104
48
60
130
133
134
131
132
146
10
15
128
129
105

PORTABLE REMOTELY CONTROLLED POP-UP TARGET APPARATUS

This invention concerns improvements in or related to target apparatus and more particularly to portable target apparatus readily adapted to firing range and open field installations.

Mechanized target systems in relatively permanent underground, ground level or elevated indoor and outdoor shooting range installations are well known and popularly employed for rifle and pistol practice. Typically in many such installations, one or more vertical planar or frame mounted targets are mounted to rotate 90° about vertical axes between full face and edge on viewing positions; each target effectively disappearing from the shooter's view in its edge on position. One such target installation of the above described character is disclosed in my U.S. Pat. No. 5,350,180 issued Sep. 27, 1994.

In another known instances the targets normally are hidden from the shooter's view and periodically raised into full view.

Because of the relatively elaborate and cumbersome nature of the aforedescribed target systems the same are generally permanently installed and not readily portable or adapted for outdoor field installation. Further, inasmuch as the targets normally employed are generally planar in nature, they do not present a realistic natural appearance to the shooter. Thus the spirit of the hunt for live game, for example, is absent.

SUMMARY OF THE INVENTION

In brief, the present invention comprises a fully portable, mechanized target apparatus comprising a ground engaging base supporting a power driven, linearally reciprocal, carriage actuator; arcuately moveable crank means driven along vertical planes by the carriage actuator, horizontally supported shaft means aligned normal to and driven by the crank means for limited partial rotation, target supports secured to the shaft for arcuate movements in response to limited rotation of the shaft means, and target means supported by and attached to the target supports and so arranged that the target means pop up into view from a substantially hidden position and vice versa in response to selected actuation of the power driven carriage actuator. Portable or conventional power supply means are provided along with remote motor controls.

An important object of this invention is to provide a fully portable, electrically powered target apparatus operable to provide pop-up target displays.

Another important object of this invention is to provide a target apparatus characterized as set out in the preceding object, which is particularly adapted for open field use and presents three-dimensional animal or other replicas of live targets to the user.

Still another object of this invention is to provide an improved and reliable power operated, remotely controlled, mechanized target apparatus useful in natural terrain and which presents pop-up targets that emulate natural animals in a realistic wild atmosphere and is particularly suited to bow and arrow equipped hunters.

An additional object of this invention is to provide a mechanized target apparatus as set out in the next preceding object which incorporates a fully portable or conventional AC power supply.

Another object of this invention is to provide a simple, efficient and reliable mechanized power operated and remotely controlled target system presenting realistic targets to the user.

Still another object of this invention is to provide an improved telescopic shaft and shaft support system.

A further important object of this invention is to provide a target support system adjustable to accommodate a variety of target sizes and configurations.

Having described this invention the above and further objects, features and advantages thereof will appear from the following detailed description of a preferred and modified embodiments illustrated in the accompanying drawings and representing the best mode presently contemplated for enabling those skilled in the art to practice this invention.

IN THE DRAWINGS

DESCRIPTION OF THE PREFERRED EMBODIMENT

Figures 1, 2:
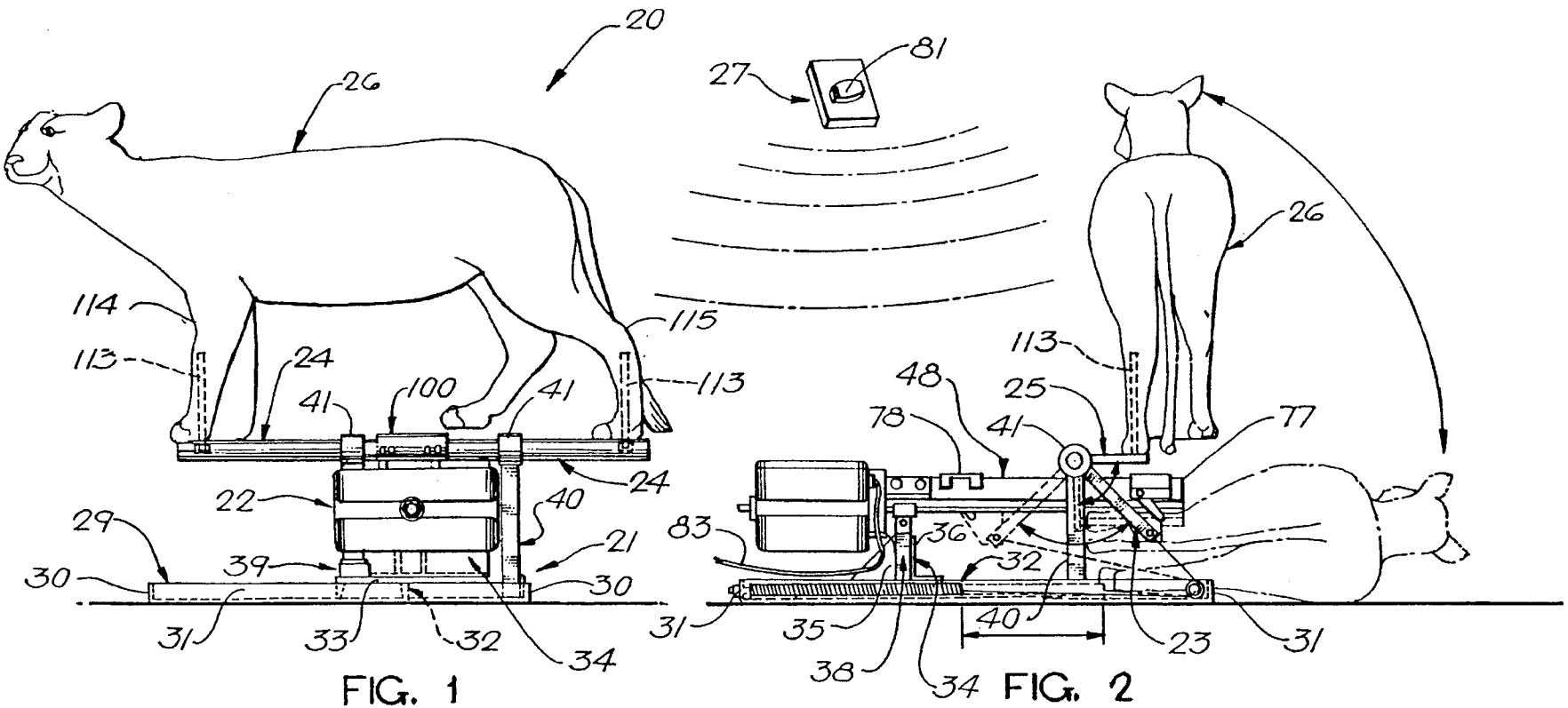
FIG. 1 is a front elevational view of a remotely controlled target system illustrative of a preferred form of the present invention.
FIG. 2 is a right hand side elevational view of the target system shown in FIG. 1, indicating the lowered position of the target in dotted lines.

With reference to FIGS. 1 and 2 of the drawings, the preferred portable target system embodiment shown therein is designated generally at 20 and comprises a ground engaging base 21, electrically powered drive means 22 mounted on the base, crank means 23 operatively connected to the drive means for rotatably driving an elevated horizontal shaft means 24 having associated target mounting means 25 adapted to secure three-dimensional target means 26 thereto. A remote electrical control unit 27 is provided for controlling operation of the drive means.

As best shown in FIGS. 1–4, the therein illustrated ground engaging base 21 comprises a rectangular frame 29 having parallel elongated side rails 30, 30 fixed, as by welding, to parallel end rails 31, 31. In the particular structure shown, rails 30 and 31 preferably are rigid, metal structural angle iron members, although other types of rigid members may be used. In addition to the rails, base 21 also includes a rigid metal cross beam 32 of U-shaped cross section, extending at right angles to and between the end rails 31, 31, intermediate and parallel to the side rails; the ends of the beam 32 being welded or otherwise rigidly affixed to the end rails. It will be noted that beam 32 is oriented in an inverted position so that wide base wall 33 thereof is uppermost for support purposes. It will be appreciated that other base configurations are readily available for supplying the supporting function of the illustrated base 21.

As shown in FIG. 1, beam 32 is located to one side of the longitudinal center line of the base frame 29 and has a heavy angle iron bracket 34 affixed intermediate its ends and at right angles thereto; such bracket being welded or otherwise rigidly connected to the upper base wall 33 of beam 32. Bracket 34 is of sufficient length to extend laterally outwardly of one side of beam 32 and is reinforced by a transverse gusset plate 35 welded to the U-beam wall 33 and a vertically or upright leg 36 of bracket 34. A vertically extending pivot post 38 is secured, as by welding, to the backside of the bracket wall 36 for purposes which will appear presently.

In addition to the pivot post 38, base frame 29 also supports a pair of co-planar, parallel spaced vertical shaft supporting posts 39 and 40, of which post 39 is cylindrical and fixed, preferably by welding, to the upper wall 33 of beam 32. Similarly post 40 is welded in an upright vertical position to the side rail 30 located nearest pivot post 38. Each of the posts 39 and 40 carries a cylindrical collar and bearing assembly 41 welded to and extending transversely across its upper end such that the two assemblies 41 are coaxially aligned for reception of shaft means 24 therethrough.

Figure 4:
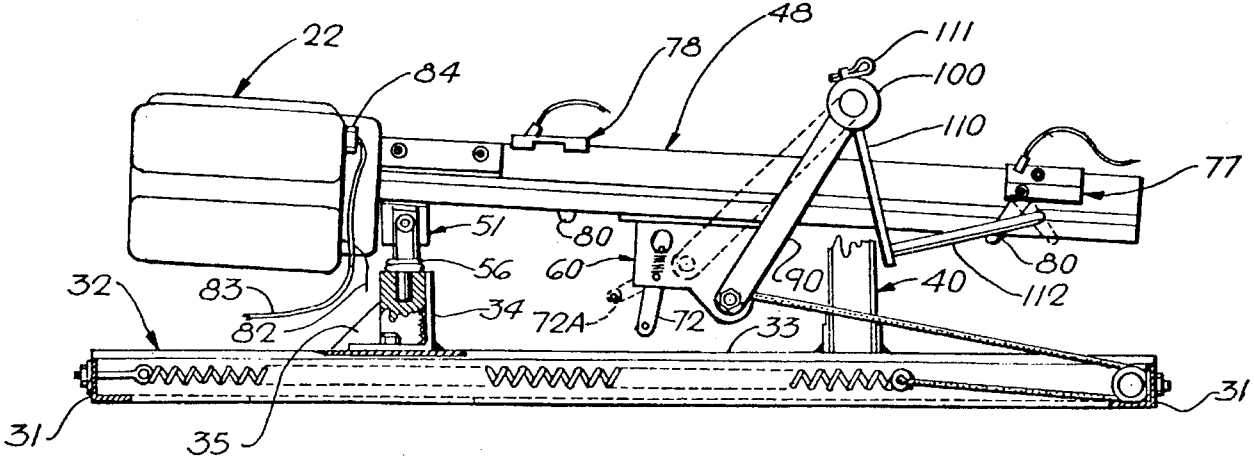
FIG. 4 is a partial enlarged side elevational view, similar to FIG. 3, but illustrating the arrangement of parts when lowering a target to a non-viewing position.
Figure 3:
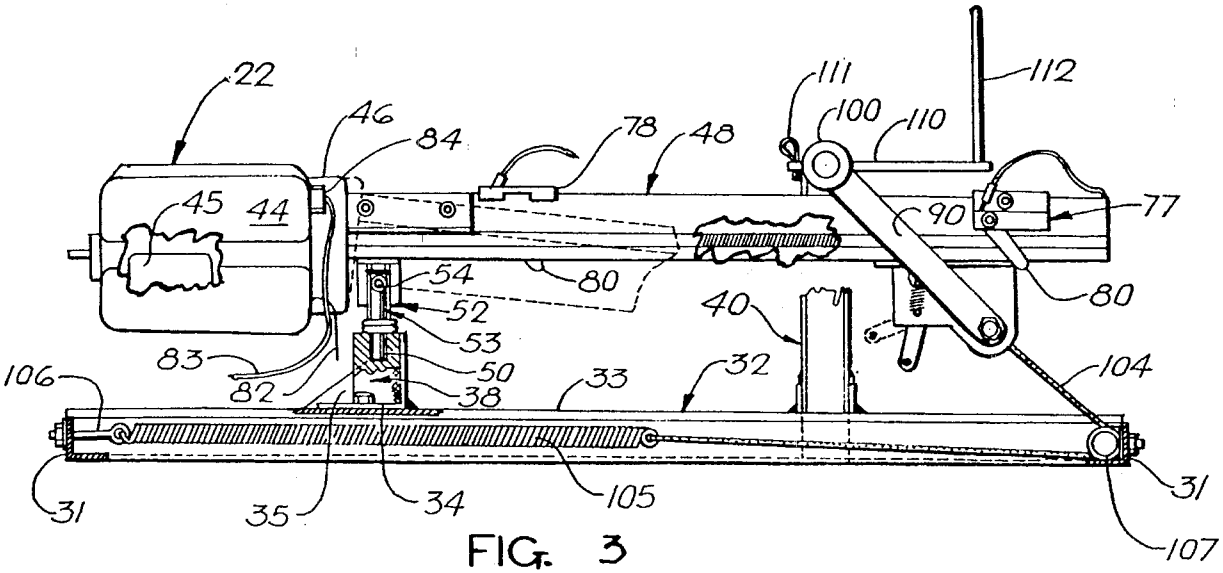
FIG. 3 is a partial enlarged side elevational view of the target system of FIGS. 1 and 2, divorced of the target and showing the arrangement of parts for elevating a target to viewing position.

Turning now to the electrical drive means 22, specific reference is made to FIGS. 1–4 of the drawings. As there shown, drive means 22 comprises an external housing 44 with electrically powered means comprising a reversible electric motor 45 and a gear reducer 46 for driving a horizontal drive screw 47 housed within a forwardly extending blade 48. The housing 44 and blade 48 are pivotally secured for movement about vertical and horizontal axes as best shown in FIGS. 3 and 4 of the drawings. As illustrated, pivot post 38 has a central bore 50 opening inwardly from its upper end for journaling pivot means 51 comprising a clamp 52 bolted to the underside of blade 48 just forwardly of the gear reducer 46 and at the approximate center of gravity of the housing and blade. A depending shouldered pivot pin 53 is pivotally fastened to the bracket 52 by a horizontal bolt 54 which provides a horizontal pivot axis that enables pivotal movements of the drive means about such bolt 54. The pivot pin 53 also is journaled for rotation about a vertical axis in the upwardly open bore 50 of post 38. A rubber donut 56 is provided about pin 53 to provide resilient support for the drive means 22.

As best shown in FIGS. 3–6, a traveling carriage actuator 60 is slidably moveable forwardly and rearwardly along the underside of the blade 48 in response the rotatable actuation of the drive screw means 47. As set out in the end view of FIG. 6, actuator 60 has two pairs of upper horizontal flanges 61, 61 and 62, 62 vertically spaced to define horizontal aligned grooves 63, 63 therebetween. Blade 48 has a bifurcated upper portion with an upwardly open groove 64 defined between a pair of parallel spaced, vertical flanges 65, 65. At the bottom portion of the blade there is an enlarged tubular section with an internal bore 66 for rotatably journaling the drive screw 47 therein. Internal side grooves 63, 63 act as guides for the upper flanges 62, 62 of the travelling carriage actuator 60.

Figures 5, 6:
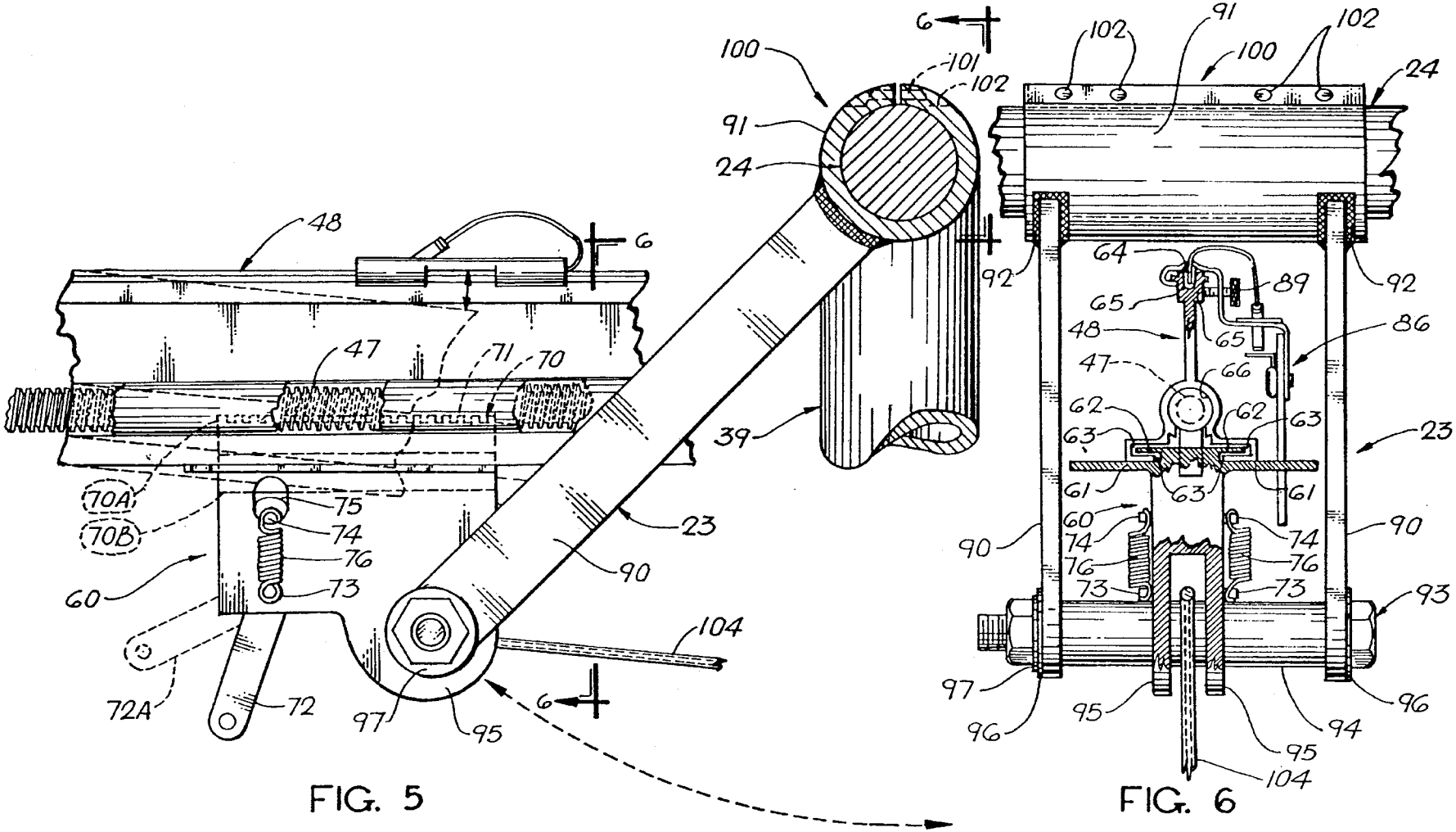
FIG. 5 is a partial, enlarged side elevational view with portions broken away in section showing the target carriage actuator and related assembly of parts.
FIG. 6 is a cross sectional view taken along vantage line 6—6 of FIG. 5 and looking in the direction of the arrows thereon.

A rack 70 is carried by the travelling carriage actuator for movement between upper and lower positions indicated by numerals 70A and 70B in FIG. 5. The rack 70 has an upper surface with partial threads or teeth 71 engageable with threads on the outside of the screw 47. In position 70A the partial threads of the rack engage the screw teeth enabling the screw to run the travelling carriage actuator along the blade in one direction or another depending on the direction of rotation of the motor 45 and screw 47.

In position 70B the rack disengages the screw so that the travelling carriage actuator can be moved freely along the blade 48 and thereby pose no resistance to movement thereof when its rack teeth are disengaged from the screw member 47.

As illustrated in FIGS. 5 and 6 in particular, means are provided in the travelling actuator 60 for adjustably shifting the rack thereof between an upper, locked position and its lower unlocked position with respect to the drive screw 47. A shift lever 72 is pivoted about pin means 73 within the carriage actuator and is moveable between a locked position shown in broken lines at 72A and an unlocked position shown in solid lines in FIG. 5. A cam mechanism 75 (partially shown) is provided in the carriage actuator for raising and lowering the rack 70 in response to operation of the shift lever 72, although other equivalent means may be employed for that function. A pair of external springs 76, 76 are connected between ears 74, 74 on the cam means and the carriage actuator for urging the rack toward its disengaged position 70B.

An electrical control circuit (partially shown) for controlling operation of the electrical drive means 22, limits movement of the traveling carriage actuator 60 in advancing and retracting directions. Such control circuit includes normally closed forward and rearward limit switches 77 and 78, respectively, secured by setscrews 79 to the blade 48 at pre-selected positions (see FIGS. 3, 4 and 6). Each limit switch has a spring biased actuating lever 80, which is engageable near the end of a stroke of the carriage actuator by one of the flanges 61 thereon. Thus when the screw 47 drives the carriage actuator in an advancing or forward direction, one of the flanges 61 engages lever 80 of forward switch 77. This opens the forward switch 77 and deenergizes the motor to stop the travelling carriage actuator at a pre-selected forward or advanced position (see FIG. 3) determined by the location of the forward limit switch on blade 48. In similar fashion, with the motor acting in a reverse direction the other flange 61 of the carriage actuator engages the rearward lever 80 of the limit switch 78, deenergizing the motor and stopping the carriage actuator at a pre-selected rearward or retracted position as determined by the location of the rear limit switch. The locations of the limit switches are selected to raise and lower target means 26 between a fully raised vertical or viewing position and a substantially horizontally lowered or hidden position, as will appear in greater detail hereinafter.

The electrical control circuit also includes the remote control unit 27 which has an actuator button 81, a battery powered internal FM transmitting circuit (not illustrated) which transmits control signals to an FM receiving antenna 82, schematically illustrated on one wall of the motor housing 44 in FIGS. 3 and 4. Alternatively, the receiving antenna may be located inside of housing 44. An internal control circuit within motor housing 44 is energized from an external AC power source over an electric power cord 83 with plug 84 to drive reversible motor 45 and actuate screw 47 in opposite directions in response to appropriate operations of the remote operating button 81. Thus with the battery properly installed in the remote control unit and power cord 83 plugged into the AC source and electrical outlet of the drive means, pressing the control button 81 successively, causes the drive motor to rotate screw 47 in one direction and then in an opposite direction to reciprocate the travelling carriage actuator along blade 48 between the limiting stop switches as above described. If desired, control unit 27 may be hardwired to the motor control circuit, although that arrangement is more restrictive to the target operator.

The aforedescribed drive means 22 and remote control unit are very similar to a conventional garage door operator assembly so it is believed unnecessary to further describe their construction and operation in detail. More specifically, the drive means 22 incorporated in this invention may comprise a modification of a known garage door opening apparatus such as that marketed under the name "GENIE" produced and sold by the Genie Company of Alliance, Ohio.

As previously noted linear actuation of the carriage actuator 60 along the track of blade 48, serves to arcuately actuate the crank means 23 and shaft means 24 attached thereto. With particular reference to FIG. 5 and 6 of the drawings, it will be understood that the crank means 23 comprises a pair of parallel spaced linear crank arms 90, 90 fixed at their upper ends to a cylindrical collar 91 as by welding, indicated at 92 in FIG. 6, so that the crank arms extend in parallel registering alignment from collar 91. At the operationally lower ends of the crank arms 90, suitable registeringly aligned, cylindrical openings (not shown) are provided for reception of a bolt and nut assembly 93 carrying a cylindrical spacing collar 94 which engages the opposing ends of the two crank arms 90, 90. The body of the bolt means 93 and the collar 94 pass through registeringly aligned openings formed in parallel spaced depending lobes 95, 95 extending from the lower side of the carriage actuator 60. It will be noted that the head of the bolt in assembly 93 is separated from the adjacent crank 90 by a washer 96 and that the nut thereon is likewise separated from its adjacent crank 90 by means of a washer 96 and lock washer 97. The assembly of the bolt and collar 94 rigidly fixes the spacing between the lower ends of the cranks 90, 90 and locks the collar against rotation whereby the latter provides an axle for movement of lobes 95 of the carriage actuator relative to collar 94 during operation.

It will be recalled that the upper end of the crank means 23 is rigidly fixed to shaft means 24. As best illustrated in FIG. 5 and 6 of the drawings, a split collar 100 easily accepts the shaft 24 therethrough in assembly. Locking pins 101 threadingly engage transverse openings 102 adjacent opposite ends of the collar to bridge the collar split and tightly clamp the collar member at a desired location about shaft 24 in a known manner.

As best shown in FIGS. 3, 4 and 5 of the drawings, actuator 60 is attached to a cable 104 having one end thereof anchored centrally to the collar 94 and its opposite end connected to a tension spring means 105 adjustably secured to and between the two end frame members 31, 31 (see FIG. 3). More specifically, an adjustable eye bolt 106 is connected to the end rail member 31 adjacent the drive means 22 to hold one end of the spring 105 while the opposite end rail 31 is equipped with a pulley wheel assembly 107 over which the cable is trained. Thus the cable extends from the mid point of collar 94, over pulley 107 and has its opposite end attached to the spring means as shown in FIGS. 3 and 4. In consequence of this arrangement, movement of the crank means 23 from its forward position, as illustrated in FIG. 3, rearwardly toward the drive means as shown in FIG. 4, tensions the spring means 105, as illustrated. Conversely, when the crank means 23 is moved to its forward position of FIG. 3 the tensioning of the spring means is relieved and is restored to its normal contracted condition as shown. Thus the tension spring means assists the drive means in advancing the crank means from its rearward position to its forward position.

It will be recalled that the shaft means 24 is rotatably mounted in the bearing assemblies 41 at the upper ends of the vertical shaft supporting posts 39 and 40; the shaft being locked axially by conventional means, such as C-rings or the like, immediately adjacent the outer ends of the bearing assemblies 41.

It also will be recalled that the shaft means 24 serve to carry and target mounting means 25 which, in the illustrated case hereof, are supported adjacent the outer ends of the shaft means, outwardly of the bearing supports.

The pop-up target mounting means 25, as shown, comprises two lift arms 110 which are planar, linear, rigid, metal bars, having one end thereof inserted through the shaft means 24 and detachably adjoined thereto for movement therewith by means of removable locking pins or cotter keys 111 as best seen in FIGS. 3 and 4 of the drawings. Further it is to be noted that lift arms 110 are in co-planar registration at opposite ends of the shaft means and that each carries a right angularly extending cylindrical mounting pin means 112 adjacent the outer end thereof; such pins being removably attached to the lift arms by having the lower ends thereof threadingly engaged with a selected position opening (not shown) in the lift arm or otherwise joined thereto.

The lift arms and mounting pins serve as connective means for attaching target means 26 to the shaft means 24 so that the target means is moveable in response to partial rotation of the shaft means in operation of the target system hereof. More specifically, it is to be noted that the target means 26 preferably is a three dimensional replica of a mountain lion in the particular illustrated case, although other animals or animant replicas may be used with equal facility. Three-dimensional replica targets are preferred because of the realistic appearance to the user of this system.

In order to couple the pin means 112 to the target means 26, it will be noted that the pin means are designed to extend into the interior of the target means, such as into mating mounting sockets 113, formed in the target's front and rear legs 114 and 115, respectively, of the illustrated target means 26. The inserted reception of the pins in the mounting sockets provides relatively secure or medium friction fit therebetween so that while the target is not readily detachable from the pins the latter nevertheless may be withdrawn for changing targets as desired.

With reference now to FIGS. 8–15 of the drawings, it will be recognized that a modified shaft assembly, indicated generally at 124 is provided for the purpose of accommodating targets of varying size and configuration.

As shown assembly 124 comprises a three piece tubular shaft made up of a mid section 125, and two smaller like end sections 126, 126 which are telescopically inserted into opposite ends of the mid section 125. All three shaft sections preferably are of polygonal (herein square) cross section with the end sections of smaller cross sectional dimension than the mid section to permit their coaxial intermating with the mid section.

With this arrangement the end sections 126, 126 are individually slidably adjustable relative to the mid section while providing an overall rigid, light-weight, telescopic shaft structure.

Figures 8, 9:
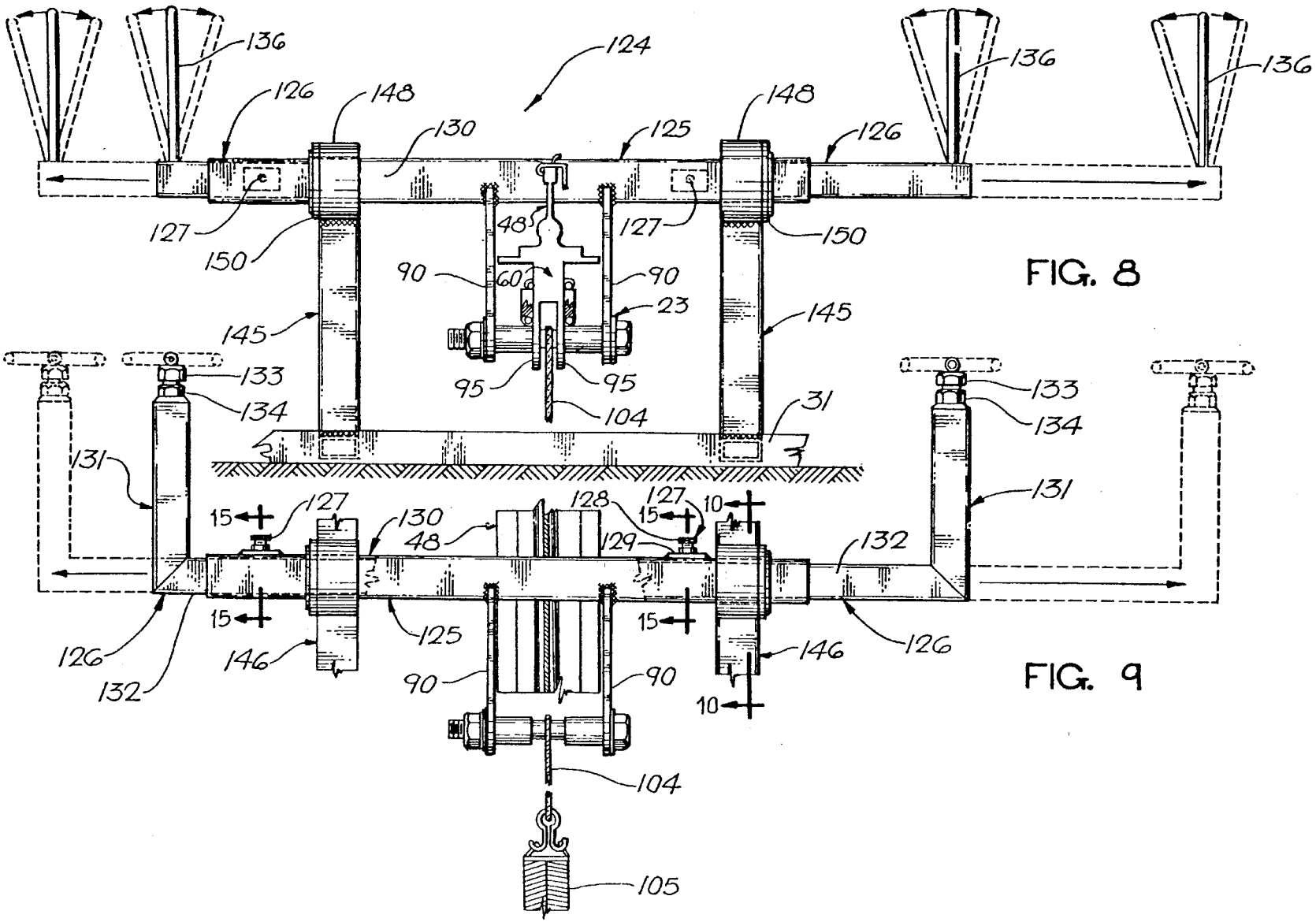
FIG. 8 is a rear elevational view of a modified telescopic shaft and adjustable target support assembly with extended shaft positions and adjustable target supports, indicated by dotted lines therein.
FIG. 9 is a top plan view of the assembly shown in FIG. 8.

In order to establish selected axial adjustment positions for the end sections 126, 126, manually actuated locking means 127, 127 are provided adjacent opposite ends of the mid section 125; each means 127 comprising a set screw 128 threaded through a nut 129 fixed to one wall 130 of the shaft mid section for movement through an opening in such wall (not shown) to engage an opposing wall of a respectively associated end section 126 (see FIGS. 8 and 9).

Figure 10:
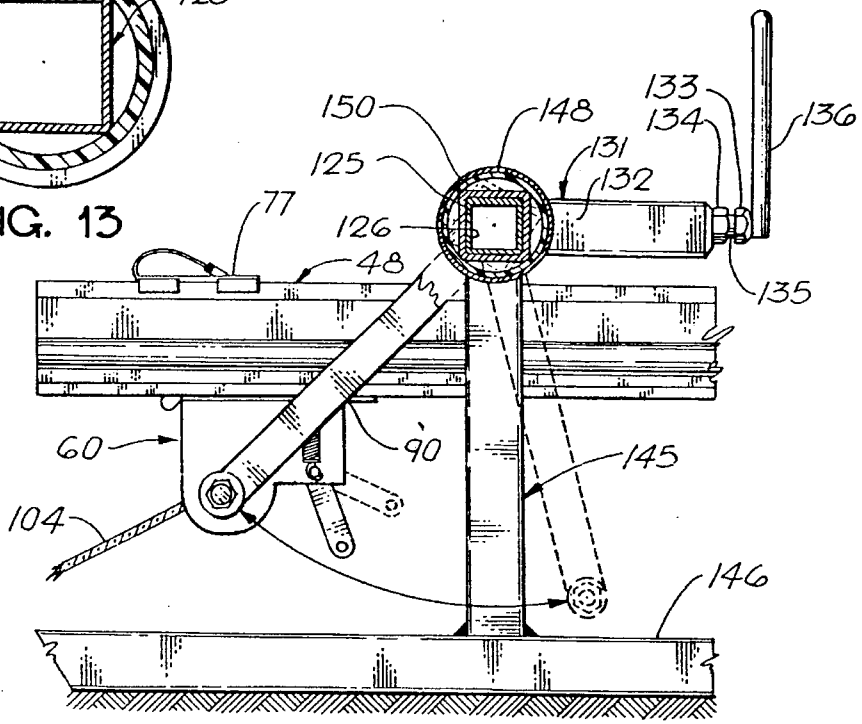
FIG. 10 is an enlarged right hand end elevational view of the FIG. 8 assembly with portions thereof shown in section taken substantially along vantage line 10—10 of FIG. 9.
Figure 13:
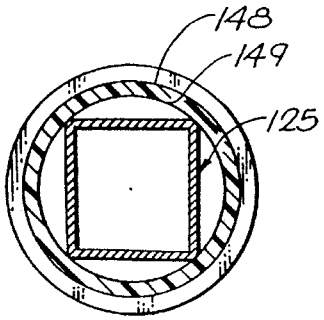
FIG. 13 is a cross sectional view taken substantially along vantage line 13—13 of FIG. 11, looking in the direction of the arrows thereon.
Figure 11:
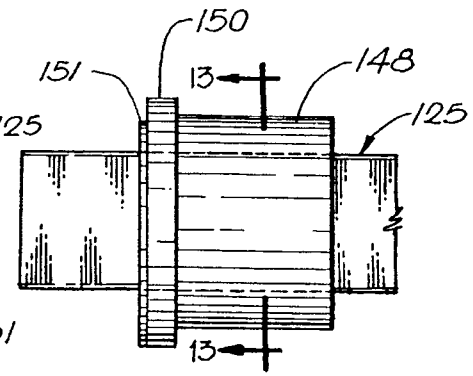
FIG. 11 is an enlarged, partial, front elevational view of the tubular shaft and support bushing embodied in the shaft assembly of FIGS. 8–10.
Figure 14:
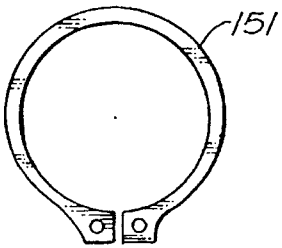
FIG. 14 is a front elevational view of a snap ring employed in the assembly of FIG. 11.
Figure 15:
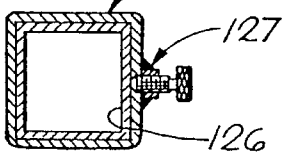
FIG. 15 is a cross sectional view of the shaft assembly taken along vantage line 15—15 of FIG. 9 and looking in the direction of the arrows therein.

It will be recognized from FIGS. 9 and 10, that each of the end sections 126 has a right angularly extending lift arm 131 at one outer end of its body 132; each such lift arm being welded or otherwise rigidly fixed to the body of its associated end section. The outer ends of the two lift arms are equipped with a pair of threaded nuts 133 and 134; the latter of which is welded over the outer open end of associated lift arm 131 for receiving a threaded stem 135 extending at right angles from the lower end of a linear mounting pin 136 corresponding to pin 110 of the previously described embodiment of this invention.

With this arrangement the mounting pin 136 on each lift arm may be moved on its stem 135 to selected angular positions from the vertical, as indicated by dotted lines in FIGS. 8 and 9. This permits a coaxial alignment of pins 136 with vertical or off vertical mounting sockets provided in the target. The second nut 133 serves as a lock nut to positively secure each pin 136 in its desired angular position. Correspondingly axial adjustment of the tubular shaft end sections, as previously related, serves to space the pins 136 to meet the lateral spacing between the target's mounting sockets, such as sockets 113 in the illustrated target means 26 of FIGS. 1 and 2 which, while shown vertical thereat, preferably are aligned coaxially of the animal target's legs for increased support and strength.

As a further alternative to the above described end sections 126, 126 having right angularly fixed related lift arms 131 at their outer ends, it is fully contemplated that circumstances may require targets having a length beyond the adjustable range of such end sections. To that end, a further modified shaft and target support structure illustrated in FIGS. 16 and 17 may be employed.

Figure 16:
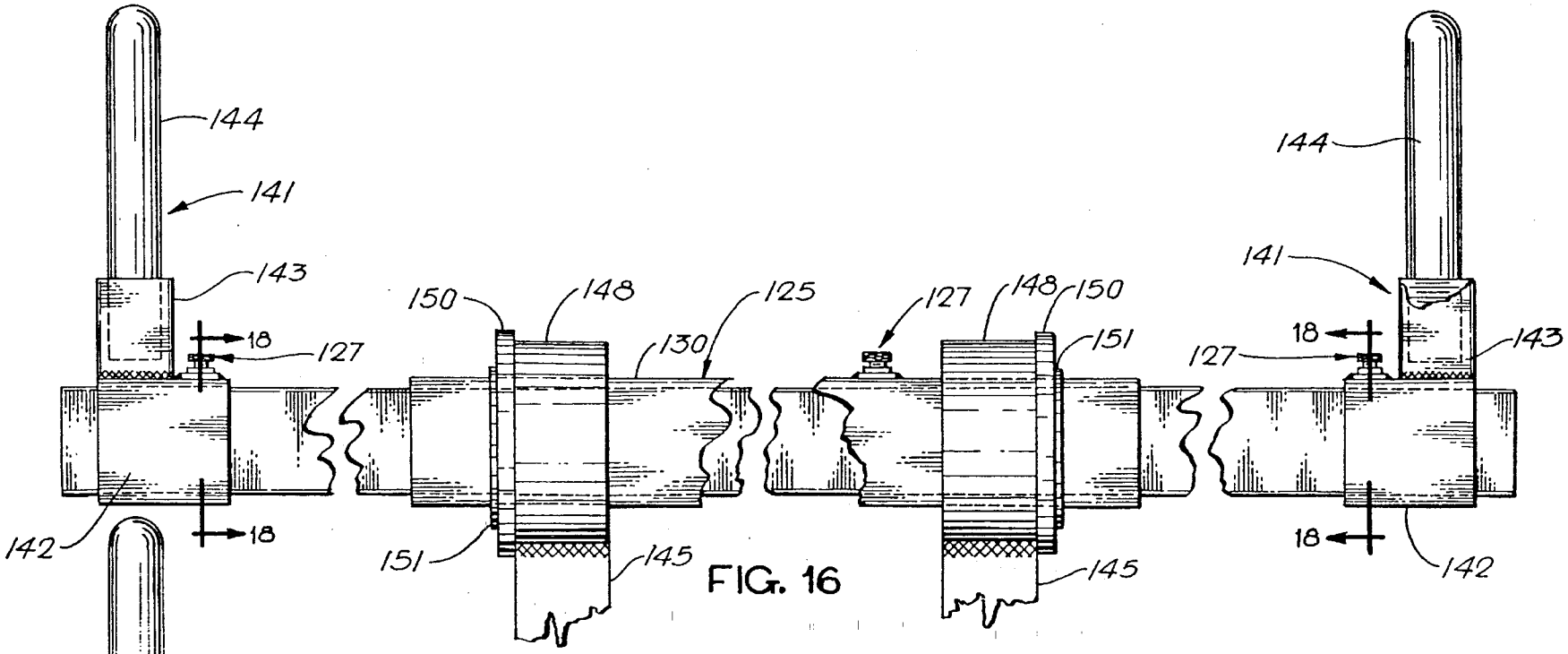
FIG. 16 is a rear elevational view of a second modified shaft assembly and target support means.

As shown best in FIG. 16 an elongated tubular inner shaft section 140, having the same polygonal cross section as the aforedescribed end sections 126, 126 replaces the latter and is mounted coaxially within the larger mid section 125 of shaft assembly 124. Shaft section 140 is longer than mid section 125 to extend axially outwardly thereof and is axially adjustable relative thereto; the same being locked in desired positions by the locking means 127.

Figure 18:
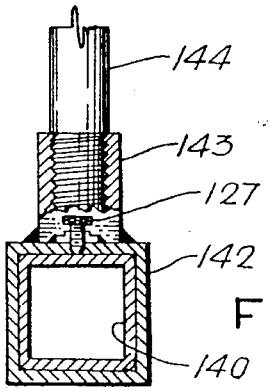
FIG. 18 is a cross sectional view taken substantially along vantage lines 18—18 of FIG. 17, looking in the direction of the arrows thereon.

A modified target support means indicated generally at 141, is employed with the inner shaft section 140. Such means 141 comprises at least two slide collars 142 each formed of a short length of tubular material identical to that employed for the mid section 125 of the above described modified shaft assembly 126. Each slide collar 142 includes a locking means 127 for securing the same at selected positions along inner shaft section 140 over which it is mounted (see FIGS. 16 and 18).

Figure 17:
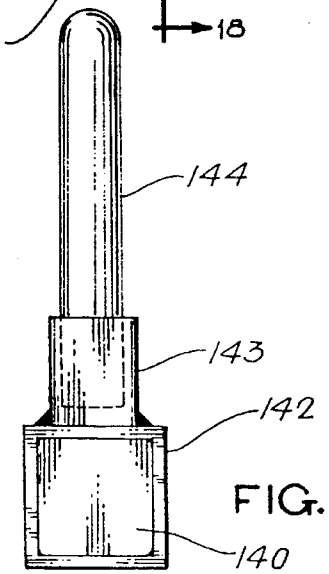
FIG. 17 is a right hand end elevational view, with portions in section, taken substantially along vantage line 17—17 of FIG. 16 and locking in the direction of the arrows thereon.

As seen in FIG. 17, each slide collar has a linear tubular lift arm 143 welded to and extending from one side thereof. The lift arm is fitted with a straight mounting pin 144 that is welded to or threadingly mounted in the outer open end of the lift arm 143 (see FIG. 18). Pin 144 is insertible into a target mounting socket such as sockets 113 of the target 26 seen in FIGS. 1 and 2. If desired the described mounting pin 136 and its adjustment means as shown in FIGS. 8–10 may be substituted for the fixed mounting pin 144 in this modification.

In both embodiments of the tubular shaft assemblies described above, it will be appreciated that the target mounting means 126–136 of FIGS. 8–10 and 142–144 of FIGS. 16 and 17 may be indexed rotatably or oriented at selected 90° positions relative to the square tubular shaft mid section 125 or the modified inner shaft section 140. This flexibility afforded by the tubular shaft assembly permits the target mounting pins to readily adjust to a variety of target configurations.

Inasmuch as the tubular shaft assembly 124 and the modification thereof shown in FIG. 16, have polygonal (herein square) cross sections, the rotatable support thereof poses special problems requiring a novel solution.

As illustrated in FIGS. 8–10, the tubular shaft assembly 124 is supported by a pair of like, upright, rigid support posts 145, 145 which are spaced laterally in coplanar alignment and rigidly fixed to laterally spaced side rails 146, 146 of a base frame similar to the arrangement shown in FIGS. 1–4.

A cylindrical bearing collar 148 is fixed, as by welding, to the upper end of each shaft support post 145. Such collars are coaxially aligned and define the rotational axis for the tubular shaft assemblies 124 or 125 and more particularly the mid section 125 thereof.

As best will be understood from FIGS. 10–15 of the drawings, each bearing collar receives a cylindrical bearing bushing 149 made of Nylon, Teflon or similar plastic materials, which is formed with a cylindrical radially protruding flange portion 150 at one end for engaging an adjacent end of an associated bearing collar 148. As shown, the bushings 149 are arranged with the flange portions thereof engaged with the laterally outboard or axially opposite ends of the two bearing collars in assembly (see FIGS. 7 and 8). The interior diameter of the two bushings 149 is substantially the same, with minor clearance, as the outside diagonal dimension of the tubular polygonal shaft mid section 125 (see FIGS. 10 and 13). Thus, the bearing bushings internally support the tubular (square) shaft section 125 for rotational movement by engaging the apices of its polygonal exterior.

Figure 12:
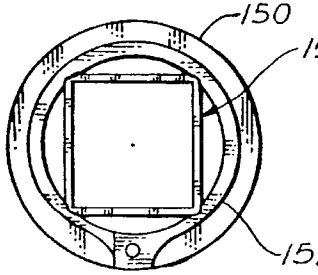
FIG. 12 is a left hand end elevational view of the FIG. 11 assembly.

The bushings are axially locked in place by snap rings 151 which engage the outer ends of bushing flange portions 150 and radially lock into recesses (unnumbered) cut across the outside corners of the polygonal exterior of the shaft mid section 125, as shown in FIG. 12. This arrangement serves to anchor the shaft mid section axially while supporting the same for partial rotation within the bushings 149 in response to arcuate actuation of the crank arms 90, 90, as previously related. It will be noted, however, that the outer ends of the crank arms 90, in the tubular shaft version of this invention illustrated in FIGS. 8–17, are connected, as by welding, directly to the tubular shaft mid section 125, thereby eliminating need for the previously described split collar 100 of the initially described structure of FIGS. 1–7.

In operation it will be appreciated that movement of the carriage actuator 60 to advance the crank means 90 to its forward travel position serves to raise the target means from a relative prone or horizontal position, as indicated in dotted lines in FIG. 2, to an upright visible and substantially vertical position as shown in full lines in FIGS. 1 and 2. Actuation of the target either to its raised or lowered position takes place in the normal course of events in response to operation of the remote controller 27. As an alternative, a timer in the nature of a time delay relay may be included in circuit with the motor 45 for automatically energizing the same after a prescribed time limit for example, 30 seconds, to automatically lower the target to a hidden or prone position thereby requiring an accelerated reaction time from the user of the system.

It also is to be recognized that as the crank means is advanced or retracted to the forward or rearward movement limits in response to activation of the actuator 60, the drive means 22 including blade 48 pivots vertically about the horizontal axis provided by bolt 54 at the upper end of the pivot pin 53. This activity indicated in FIGS. 3 and 4, permits the desired arcuate movement of the crank arms 90.

Figure 7:
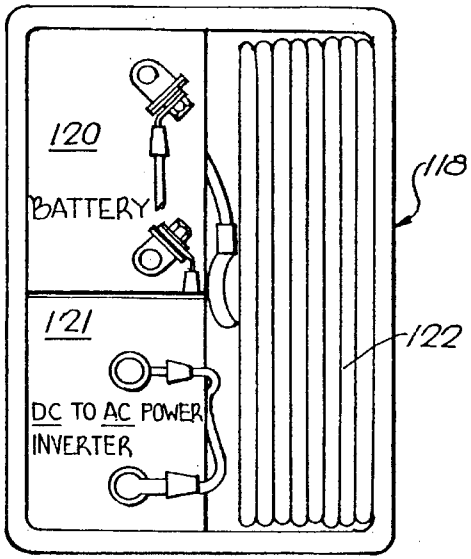
FIG. 7 is a top plan view of a portable battery and AC convertor power supply for activating the target system hereof.

In order to power the drive means and its related circuitry, the electrical power cord 83 may be connected to a conventional 60 cycle, 120 Volt AC outlet if available. For field use, however, a portable power supply 117 as illustrated in FIG. 7, is used. As therein shown a protective outer casing 118, preferably of metal of sufficient strength to withstand the impact of a bullet or an alternative high impact missile resistant material is employed to provide a generally rectangular shaped interior chamber 119 of sufficient size to accommodate a wet cell battery 120 having circuit connection with a DC to AC power inverter 121 and an extension cord 122, connectible directly to the power outlet of the drive means or to the power cord 83.

It is believed that from the foregoing that those familiar with the art will readily recognize and appreciate the novel aspects of the present invention and its advancement over the prior art and will understand that while the same is herein described in association with illustrated preferred and modified embodiments thereof, the same is nevertheless susceptible to changes, modification and substitutions of equivalents without departing from the spirit and scope of the invention which is intended to be unlimited by the foregoing described embodiments of this invention except as appears in the following appended claims.

The embodiments of the invention in which an exclusive property or privilege is claimed are defined as follows:

1. A self-contained, power operated, portable, mechanized, pop-up target apparatus, comprising:

a ground engaging base, power actuated drive means mounted on said base for pivotal movement about a horizontal axis;

said drive means rotatably driving elongated means selectively coupled to a carriage actuator for linearly reciprocating the latter along said elongated means;

said drive means comprising a reversible electric motor, limit switch means engageable with said actuator for deenergizing said motor, and control means for selectively energizing said motor and determining the direction of rotation thereof;

elongated shaft means rotatably supported in elevated position over said base at right angles to said elongated mean;

said shaft means composed of plural, telescopingly interfitted, coaxial, tubular members, including a linear tubular mid section, having mating polygonal cross sections;

means for interlocking said tubular members in selected axial positions;

means for rotatably supporting said shaft means comprising a pair of laterally spaced, coaxially aligned, plastic bearing bushings supporting said mid section, and means for axially interlocking said bushings and mid section with stationary support posts;

vertically oriented crank means pivotally coupled to said actuator and affixed to said shaft means for partially rotating said shaft means in reaction to limited reciprocating movements of said actuator; and target means comprising at least one three-dimensional, replica of a live target mounted for arcuate movements between substantially horizontal hidden and vertical display positions in response to rotational movement of said shaft means.

2. The apparatus of claim 1, wherein said bushings have cylindrical interiors engageable with polygonal extremities of said mid section.

3. The apparatus of claim 1 and a tubular inner shaft section telescopically mounted matingly within said mid section; said inner shaft section being longer than said mid section; and means for axially interlocking said mid section and inner shaft section.

4. The apparatus of claim 3, and target supports comprising members coaxially moveable over the exterior of said inner shaft section, means for securing said members to said inner shaft section at selected locations axially outwardly of said mid section, and an elongated target engaging pin extending from each of said target supports for insertion into a mating socket connector in said target means.

5. The apparatus of claim 1, and plural target supports comprising tubular members of mating polygonal cross section telescopically joined with opposite ends of said mid section, means for securing said target supports at selected positions along the axis of said mid section, elongated pins extending transversely from said each of said target supports, and means presented by said said target means connectively receptive of said pins.

* * * * *

UNITED STATES PATENT AND TRADEMARK OFFICE

CERTIFICATE OF CORRECTION

PATENT NO. : 5,603,505

DATED : February 18, 1997

INVENTOR(S) : Joseph Acock

It is certified that error appears in the above-identified patent and that said Letters Patent is hereby corrected as shown below:

Col. 3, line 1, delete "locking", and substitute -- looking --;

Col. 10, line 16, delete "mean" and substitute -- means --.

Signed and Sealed this

Twenty-fourth Day of June, 1997

Bruce Lehman

*Attest:*

BRUCE LEHMAN

*Attesting Officer*

*Commissioner of Patents and Trademarks*